United States Patent [19]

Akagi

[11] Patent Number: 4,674,464

[45] Date of Patent: Jun. 23, 1987

[54] ELECTRIC EXHAUST GAS RECIRCULATION VALVE

[75] Inventor: Motonobu Akagi, Anjo, Japan

[73] Assignee: Aisin Seiki Kabushiki Kaisha, Kariya, Japan

[21] Appl. No.: 780,001

[22] Filed: Sep. 25, 1985

[30] Foreign Application Priority Data

Sep. 25, 1984 [JP] Japan ..... 59-201049

[51] Int. Cl.[4] ..... F02M 25/06

[52] U.S. Cl. ..... 123/571

[58] Field of Search ..... 123/568, 569, 571; 251/129.05, 129.11, 133

[56] References Cited

U.S. PATENT DOCUMENTS 3,774,583 11/1973 King ..... 123/568
3,925,989 12/1975 Pustelnik ..... 123/571 X
4,064,851 12/1977 Wessel ..... 123/571
4,412,517 11/1983 Kobashi et al. ..... 251/129.11
4,432,331 2/1984 Yasuhara ..... 123/571
4,561,408 12/1985 Jenkins ..... 123/571

FOREIGN PATENT DOCUMENTS 2101715 1/1983 United Kingdom ..... 123/571

*Primary Examiner*—Willis R. Wolfe, Jr.
*Attorney, Agent, or Firm*—Oblon, Fisher, Spivak, McClelland & Maier

[57] ABSTRACT

An electrically actuated EGR valve controls the recirculation of exhaust gases in an internal combustion engine. The EGR valve includes a step motor having a linearly moving motor shaft engaging a rod of a poppet valve for communicating an exhaust gas inlet port with an exhaust gas outlet port. An insulator and a cooling atmosphere chamber separate the step motor from the heat of the exhaust gases.

7 Claims, 2 Drawing Figures

ELECTRIC EXHAUST GAS RECIRCULATION VALVE

BACKGROUND OF THE INVENTION

1. Field of the Invention

This invention generally relates to exhaust gas recirculation (EGR) valves of the type mounted in an exhaust gas recirculation system of an internal combustion engine. Such EGR valves are provided for the control of recirculation of exhaust gases, including uncombusted gases, discharged from the engine into the intake manifold. Such exhaust gas recirculation reduces the concentration of toxic waste gas in the exhaust gases, such as Nox gases. More particularly, the invention relates to an electrically actuated EGR valve which is operated by a step motor.

2. Related Art of the Invention

An example of a conventional EGR valve is disclosed in Japanese Utility Model Publication No. 53-88622 (1978). This publication discloses an EGR valve controlling the recirculation of exhaust gases in response to engine drive conditions of an internal combustion engine. This conventional EGR valve includes a signal chamber connected with an EGR port which generates a vacuum in response to the throttle valve opening degree. A diaphragm piston operates in response to the vacuum in the signal chamber and moves a valve which controls the exhaust recirculation gas passage. The rod of the valve and the rod of the diaphragm piston are integrally connected to one another. Thus, the conventional EGR valve controls the amount of exhaust gases through a diaphragm piston operated in response to a vacuum signal.

However, it is difficult for the conventional EGR valve to accurately and reliably control the amount of exhaust gases in response to engine drive conditions, and so inconsistent exhaust gas recirculation easily arises. Furthermore, the conventional EGR valve has a poor transient response characteristic on account of the time required to communicate a vacuum to a signal chamber from the EGR port.

SUMMARY OF THE INVENTION

A principal object of the present invention is to provide an improved EGR valve for an EGR system of an internal combustion engine.

It is a further object of the present invention to provide an electrically actuated EGR valve wherein a step motor replaces a conventional diaphragm piston.

Another object of the present invention is to provide an electrically actuated EGR valve including a poppet valve having a valve rod.

A further object of the present invention is to provide an electrically actuated EGR valve including a step motor having a shaft which transmits a drive of the step motor via a rotating screw.

Still another object of the present invention is to provide an electrically actuated EGR valve including an insulator and a cooling atmosphere chamber.

It is yet another object of the present invention to provide an electrically actuated EGR valve which is economical to manufacture, comparatively simple in construction, and thoroughly reliable in operation.

In one illustrative embodiment of the present invention, there is provided an electrically actuated EGR valve which includes a step motor. The conventional diaphragm piston is replaced by a mechanism associated with the step motor for converting rotational motion into translational motion. The conventional diaphragm piston is replaced by a poppet valve having a valve rod and being slidably disposed in an axial direction of the housing. An insulator is disposed between the open end of the valve and the motor. Moreover, a cooling atmosphere chamber is formed in the open end of the motor, so that the valve rod and the motor shaft may be thermally separated from one another.

The step motor incrementally rotates a hollow screw thereof in response to discrete electric pulse signals from a computer, the computer in turn receiving signals of engine drive conditions. The rotating screw has internal threads which mesh with external threads of a motor shaft extending therethrough. The shaft is prevented from rotation, which converts the rotational motion into linear motion of the shaft. The shaft in turn engages the valve rod to open and close the valve.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF A PREFERRED EMBODIMENT

Figure 2:
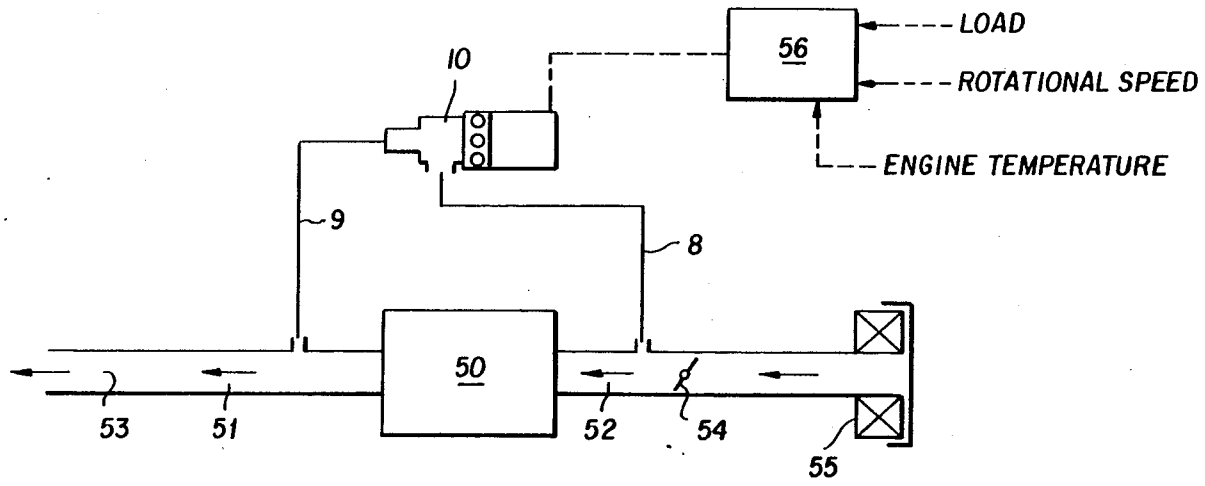
FIG. 2 is a schematic illustration of an EGR system adopting an electrically actuated EGR valve according to the present invention.

Reference will first be made to FIG. 2 showing an EGR system adopting an electrically actuated EGR valve of the present invention. As is conventional, an engine 50 is provided with an intake system including an intake manifold 52 and an exhaust system 53 including an exhaust manifold 51. The intake system includes a throttle valve 54 and an air cleaner 55, as is conventional. The intake and exhaust manifolds are connected to one another via EGR valve 10. More particularly, exhaust gas flow lines 8 and 9 are respectively connected between the intake manifold and the EGR valve, and between the exhaust manifold and the EGR valve so that exhaust gas from the exhaust manifold can circulate to the intake manifold via the EGR valve.

The electrically actuated EGR valve 10 controls the amount of exhaust gas circulated to the intake manifold in response to electric signals from the computer 56 which receives electric or fluid signals related to the drive conditions of the engine, such as the engine rotational speed, engine temperature, engine load and the amount of throttle opening. The computer 56 and the manner in which it generates signals for the EGR valve are conventional.

Figure 1:
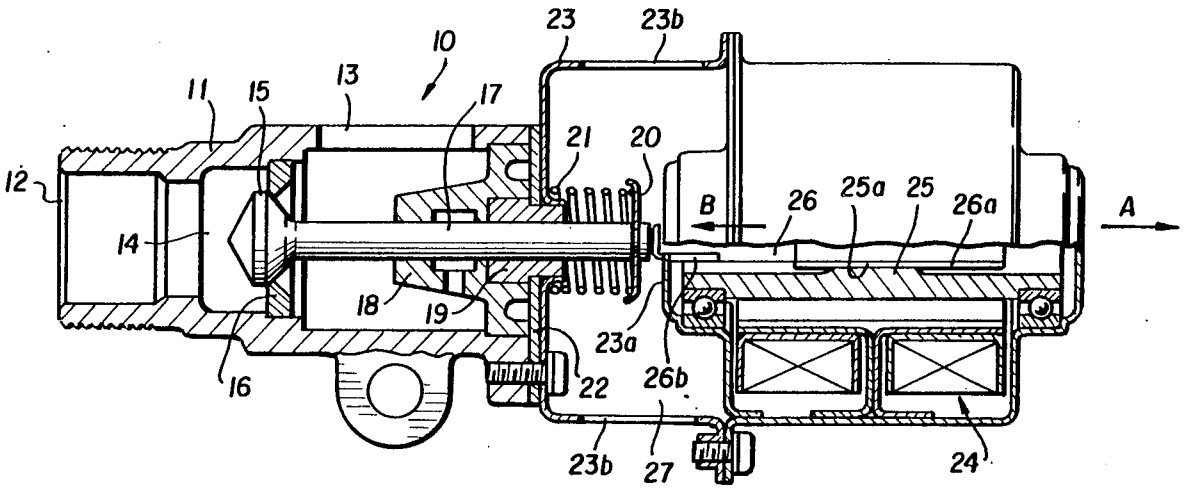
FIG. 1 is a sectional view of an electrically actuated EGR valve in accordance with an embodiment of the present invention.

Referring to FIG. 1, the electrically actuated EGR valve 10 includes a housing 11 having an exhaust gas inlet port 12 connected with the engine exhaust manifold 51 via the line 9, and an exhaust gas outlet port 13 connected with the engine intake manifold 52 via the line 8. Exhaust gases from the engine exhaust manifold may flow into the inlet port 12, pass through an exhaust recirculating passage 14, flow out from the outlet port 13 and flow into the intake manifold, thereby providing exhaust gas recirculation.

The passage 14 between the inlet port 12 and the exhaust port 13 is provided with a valve seat member 16 which can be closed by engagement with a poppet valve 15 for controlling the amount of exhaust gas recirculating through the gas passage 14. The poppet valve 15 is integrally formed with a valve rod 17 which can slide in its axial direction for opening and closing the poppet valve. The valve rod 17 is slidably supported by a bearing 19 mounted on a holder member 18 which is in turn secured to the valve housing 11. The poppet valve is normally biased by a spring 21 into contact with the seat member 16 to close the valve. The spring is supported by a spring retainer 20 fixed on the end of the valve rod 17 opposite the valve 15.

A motor casing 23 is fixed to the valve housing 11 with an insulator 22 positioned therebetween. An electric step motor 24 is accommodated in the casing 23. The step motor 24 includes a hollow screw 25 which is rotatably mounted within the motor and is incrementally driven in rotation by the motor in response to discrete pulse signals from the computer 56. The hollow screw 25 has internal threads **25*a* which mesh with external threads 26*a* of a motor shaft 26. The motor shaft 26 is positioned within the hollow screw and is constrained to move only in the axial direction by the end of a flange 23*a* which engages an axial slot 26*b* of the motor shaft 26**.

The step motor incrementally rotates the screw 25 in one direction in response to discrete signals of one sense, in order to move the motor shaft 26 in the B direction. The engagement of the end of the motor shaft with the end of the valve rod 17 opens the poppet valve, the amount of opening of the poppet valve being determined by the incremental rotation of the step motor. Rotation of the screw 25 by the step motor in the opposite direction in response to discrete signals of an opposite sense cause the shaft 26 to move in the direction A, thereby permitting the spring 21 to retract and close the poppet valve 15. As a result, the rotational movement of the step motor in response to signal pulses is converted to translational movement of the valve rod 17 for opening and closing the valve.

The force of the spring 21 is set to be lower than the drive force of the step motor 24, whereby the poppet valve 15 can be opened against the biasing force of the spring 21.

The interior of the motor casing 23, including the cupola of the valve rod 17 and the motor shaft 26 is formed as a cooling atmosphere chamber 27 by being connected with the outside air via openings **23*b* in the motor casing 23**.

The computer 56 converts signals indicative of the drive conditions of the engine, including engine rotational speed, engine temperature and the throttle opening degree, into electric signals which are supplied to the step motor. The step motor 24 incrementally controls the rotational angle of the screw 25 in response to these discrete electric pulse signals from the computer, whereby the shaft 26 and the valve rod 17 are accurately controlled. Consequently, the amount of EGR gases can be controlled accurately and reliably in response to the drive conditions of the engine.

According to the present invention, the valve rod 17 is formed separate from the motor shaft 26 so that the step motor 24 can be thermally isolated from the exhaust gases which are at a high temperature (approximately 350° C.) when passing through the exhaust recirculation passage 14. The insulator 22 is disposed between the housing 11 and the motor casing 23, and the cooling atmosphere chamber 27 is formed at an open end of the motor casing 23, so that the step motor 24 may be further isolated from the thermal influence of the exhaust gases.

Since the valve rod 17 is formed separately from the shaft 26, the valve mass is reduced, thereby improving the transient response of the valve and minimizing the transfer of vibrations from the motor to the valve. Furthermore, due to the separate construction of the valve rod 17 and the motor shaft 26, backlash occuring in the conversion of rotational motion to translational motion by the screw 25 is not directly transmitted to the valve rod 17, thereby providing improved control accuracy.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An electrically actuated EGR valve for controlling EGR gases in response to electric signals from a computer, said EGR valve comprising:

a valve housing having an exhaust gas inlet port for passage of exhaust gases therethrough, an exhaust gas outlet port, and an exhaust gas passage extending therebetween;

poppet valve means for selectively opening and closing said exhaust gas passage, said poppet valve means including a valve rod slidably supported for movement in a linear direction in said housing;

an electric step motor responsive to electric pulse signals and including output means for directly contacting and moving said valve rod; and a motor casing, said motor casing secured to said valve housing with an insulating element therebetween, whereby said step motor is isolated from heat from said exhaust gases and wherein said motor casing includes a plurality of apertures formed therein whereby air may be circulated into said motor casing to further thermally isolate said step motor.

2. The valve of claim 1, wherein said motor shaft and said valve stem are not integrally formed.

3. The valve of claim 1, wherein said exhaust gas inlet port is connected to a source of exhaust gas in an internal combustion engine, and wherein said exhaust gas outlet port is connected to an intake manifold of said internal combustion engine.

4. The valve of claim 1 including spring means for biasing said valve stem into contact with said motor shaft.

5. The valve of claim 1 including a cooling atmosphere chamber in communication with said plurality of apertures formed in said motor casing and formed at an open end of said motor casing whereby said step motor is further thermally isolated from said exhaust gases.

6. The valve of claim 1, wherein said output means for directly contacting and moving said valve rod comprise a linearly movable motor shaft directly contacting an end of said poppet valve, and means for converting an incremental rotational movement of said step motor into linear movement of said motor shaft.

7. The valve of claim 6, wherein said means for converting an incremental rotational movement comprises a hollow screw rotatably driven by said step motor, said hollow screw having internal threads meshing with external threads of said motor shaft, and means for preventing rotation of said motor shaft.

* * * * *